US010352093B2

(12) United States Patent
Mitchell et al.

(10) Patent No.: US 10,352,093 B2
(45) Date of Patent: Jul. 16, 2019

(54) STACKABLE WEATHERSTRIP

(71) Applicant: Royal Group, Inc., Atlanta, GA (US)

(72) Inventors: Steven A. Mitchell, Chilhowie, VA (US); Robert E. Rabago, Glade Spring, VA (US)

(73) Assignee: ROYAL GROUP, INC., Atlanta, GA (US)

( * ) Notice: Subject to any disclaimer, the term of this patent is extended or adjusted under 35 U.S.C. 154(b) by 0 days.

(21) Appl. No.: 15/377,487

(22) Filed: Dec. 13, 2016

(65) Prior Publication Data

US 2017/0175437 A1 Jun. 22, 2017

Related U.S. Application Data

(60) Provisional application No. 62/268,749, filed on Dec. 17, 2015.

(51) Int. Cl.
*E06B 3/48* (2006.01)
*E06B 7/23* (2006.01)

(52) U.S. Cl.
CPC ..... *E06B 7/2314* (2013.01); *E06B 7/231* (2013.01); *E06B 3/485* (2013.01); *E06B 7/2316* (2013.01)

(58) Field of Classification Search
CPC ..... E06B 7/231; E06B 7/2316; E06B 7/2305; E06B 7/2307; E06B 5/164
USPC ..... 49/496.1
See application file for complete search history.

(56) References Cited

U.S. PATENT DOCUMENTS

| | | | | |
|---|---|---|---|---|
| 3,360,888 | A | 1/1968 | Protzman | |
| 4,262,450 | A * | 4/1981 | Anderson | E06B 3/4618 49/425 |
| 4,497,137 | A * | 2/1985 | Nelson | E06B 7/231 49/495.1 |
| 5,092,079 | A * | 3/1992 | Brookman | E06B 3/485 160/40 |
| 5,279,087 | A * | 1/1994 | Mann | E06B 5/164 49/477.1 |
| 5,356,694 | A | 10/1994 | Knapp | |
| 6,167,657 | B1 * | 1/2001 | Burge | B29C 44/22 156/244.11 |
| 6,360,489 | B1 * | 3/2002 | Burge | B29C 44/22 156/244.11 |
| 2002/0113377 | A1 * | 8/2002 | Mann | E06B 7/2316 277/628 |

FOREIGN PATENT DOCUMENTS

| | | |
|---|---|---|
| CA | 2219735 A1 | 5/1998 |

OTHER PUBLICATIONS

International Search Report and Written Opinion of PCT/CA2016/051488 dated Feb. 21, 2017.

* cited by examiner

*Primary Examiner* — Katherine W Mitchell
*Assistant Examiner* — Abe Massad
(74) *Attorney, Agent, or Firm* — Polsinelli PC; Eric J. Hanson

(57) ABSTRACT

A weatherstrip with improved stackability has a rigid base portion including a planar surface and a flexible strip portion adhered over a corner of the base portion and extending outwardly at an angle to the planar surface of the base portion.

18 Claims, 3 Drawing Sheets

STACKABLE WEATHERSTRIP

CROSS-REFERENCE TO RELATED APPLICATIONS

This application claims the benefit of priority of U.S. provisional application No. 62/268,749, filed Dec. 17, 2015, which is incorporated herein by reference.

BACKGROUND

U.S. Pat. No. 6,360,489, incorporated herein by reference, discloses a cellular polyvinyl chloride (PVC) weatherstrip for garage doors which is generally extruded by known processes as including a cellular PVC base and non-cellular, flexible strip portion as shown in FIG. 1.

However, when such conventional weatherstrips are stacked for shipping or storage, the base and strip portions of adjacent weatherstrips generally interfere with one another. Undesirable shifting may also occur with stacking and transporting of the prior art weatherstrips. As a result, there is a need for an improved weatherstrip structure in order to avoid inefficient, disorganized and potentially damaging results in packing, transporting and storing a plurality of weatherstrips.

SUMMARY

The present invention provides an improved weatherstrip structure for garage doors with better stackability. In one embodiment a tapered, angled non-cellular strip portion is extruded at a corner of a cellular PVC base portion. The tapered geometry increases stiffness of the strip portion (i.e. weather seal) and the corner placement with improved adhesion location surface area between the strip portion and base increases adhesion of the strip portion to the base portion.

In further embodiments of the invention an angled edge is provided along the base portion opposite the corner adhesion. The angled edge provides improved stackability of weatherstrips of the invention as an adjacent angled strip portion of an adjacent weatherstrip avoids interference with a base portion of an adjacent, stacked weatherstrip. In other words, the modified angling of a base portion edge in the present invention permits the subsequent stacked weatherstrip's strip portion to extend in an angled and outward manner without being pressed and interfered with by a traditional flat corner edge as occurs with conventional weatherstrips that are stacked.

BRIEF DESCRIPTION OF THE DRAWINGS

In order to facilitate a fuller understanding of the exemplary embodiments, reference is now made to the appended drawings. These drawings should not be construed as limiting, but are intended to be exemplary only.

DETAILED DESCRIPTION OF PREFERRED EMBODIMENTS

The following description is intended to convey an understanding of the embodiments of the invention by providing embodiments and details involving an improved weatherstrip for garage doors. It is understood, however, that the invention is not limited to these specific embodiments and details, which are exemplary only. It is further understood that one possessing ordinary skill in the art, in light of known devices, systems and methods, would appreciate the use of the invention for its intended purposes and benefits in any number of alternative embodiments.

It will be appreciated from the details described in incorporated-by-reference U.S. Pat. No. U.S. 6,360,489 and processes known to those skilled in the relevant art that methods for extruding a weatherstrip for garage doors that includes a cellular PVC base portion and non-cellular, flexible extrudate strip portion are known in the art. It will be apparent to skilled in the art that such known extrusion methods may be readily implemented to manufacture weatherstrips according to the present invention.

Figure 1:
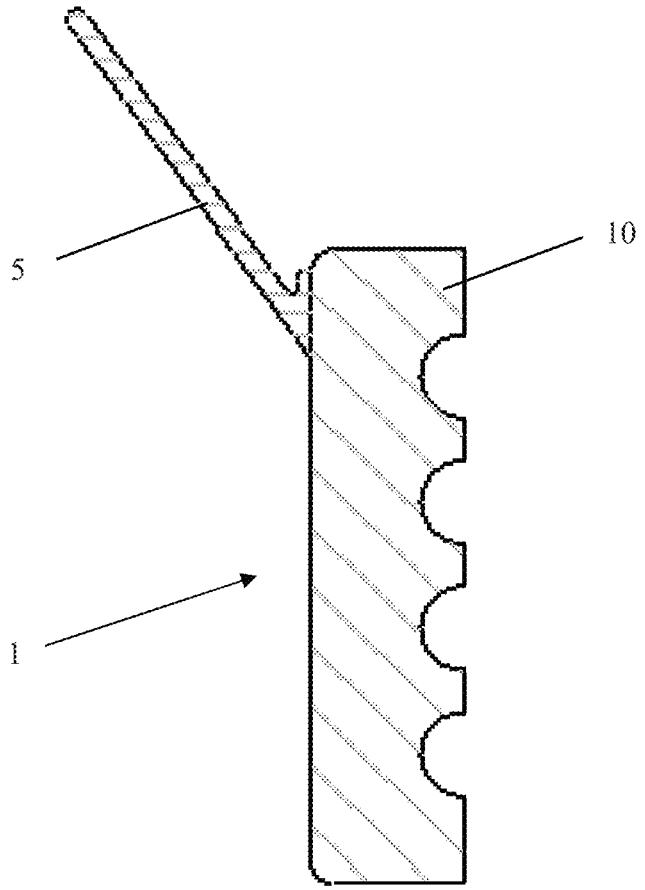
PRIOR ART FIG. 1
FIG. 1 is a plan view of an end of a prior art weatherstrip.
Figure 2:
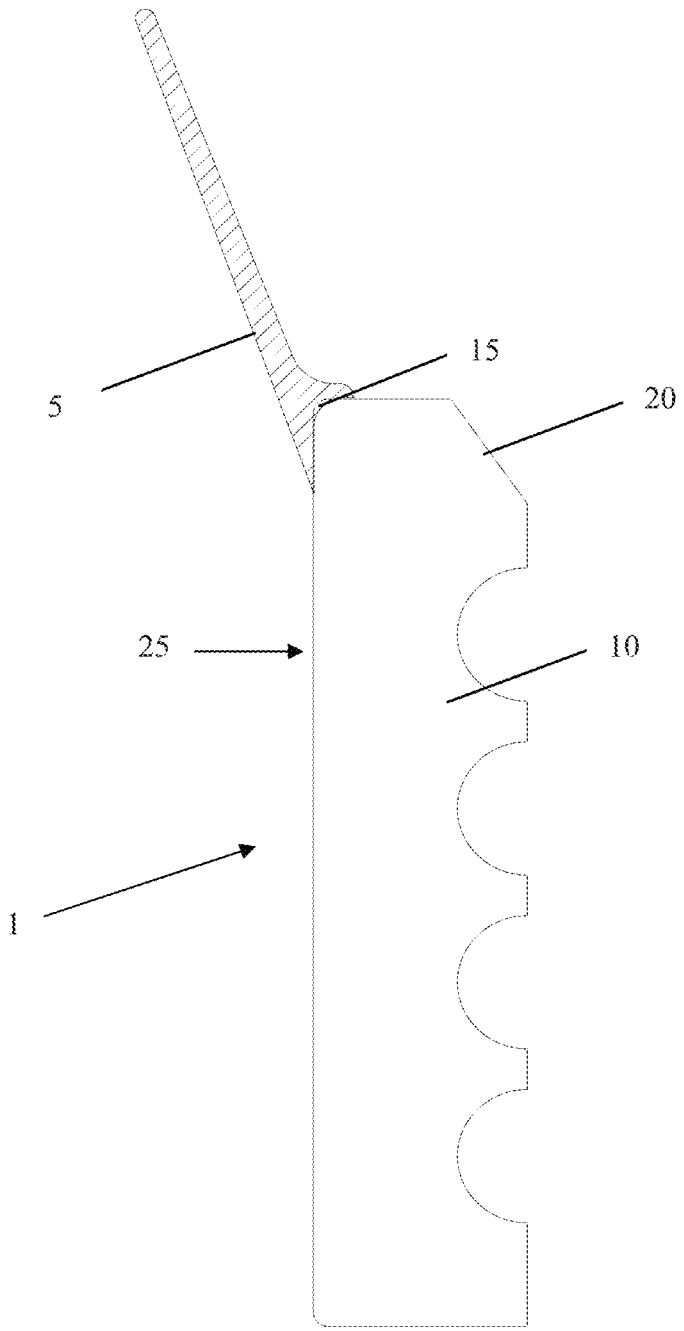
FIG. 2 is a plan view of an end of a weatherstrip according to an embodiment of the invention.

Referring to FIG. 2 in comparison to the prior art weatherstrip 1 shown and described in FIG. 1, in an embodiment of the present invention an angled non-cellular, flexible strip portion 5 is extruded to adhere over a corner adhesion location 15 of a rigid base portion 10 and extend outwardly at an angle from a generally planar surface 25 of base portion 10. Rigid base portion may be comprised of cellular PVC in preferable embodiments. In some embodiments the strip portion 5 may optionally be tapered.

Further, in embodiments of the invention, an angled edge 20 of the base portion 10 is provided opposite the corner adhesion location 15 where the strip portion 5 adheres. In other embodiments, flexible strip portion 5 may be adhered to corner adhesion location 15 of base portion 10 by other chemical, mechanical and/or thermal bonding and adhesion techniques than as an extrudate. It will also be appreciated that rigid based portion 10 may comprise alternative materials to cellular PVC.

Figure 3:
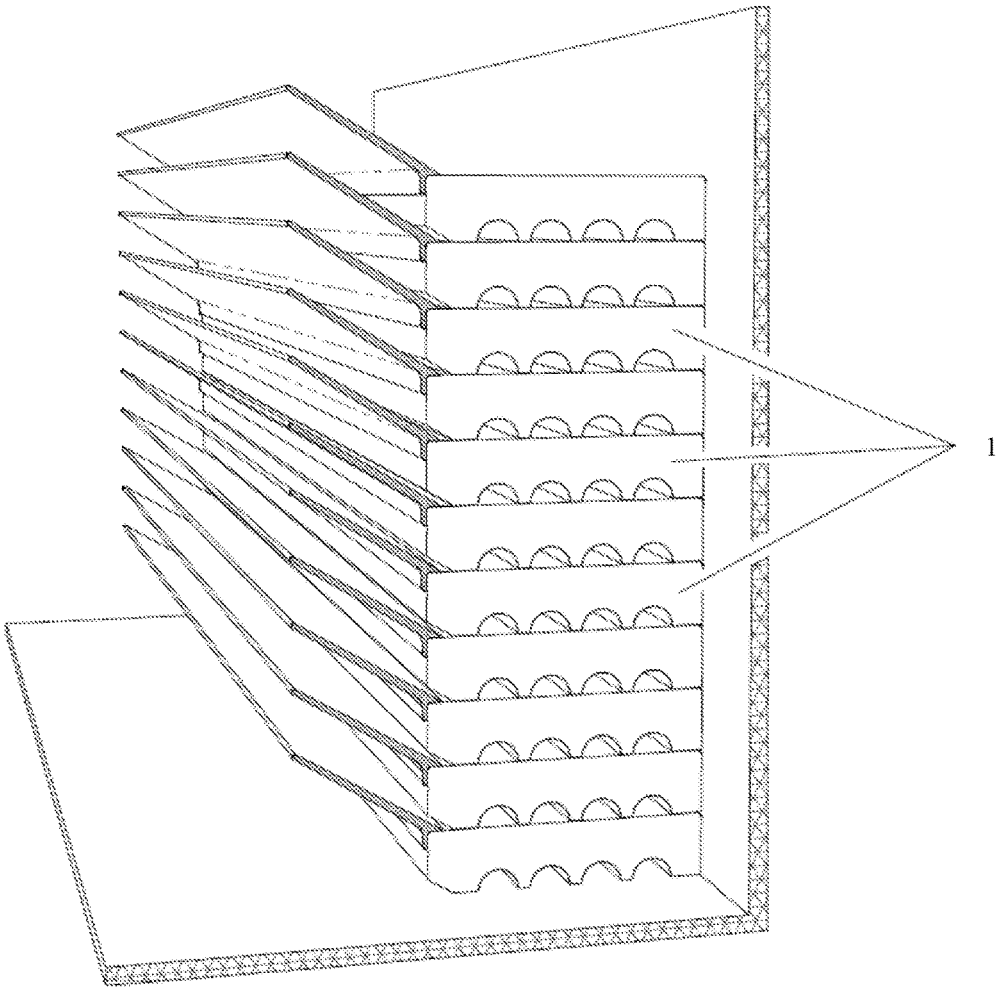
FIG. 3 is a perspective view of the ends of stacked weatherstrips according to an exemplary embodiment of the invention.

By moving the strip portion from an outer, flat surface adhesion location of the prior art to the corner location 15 of the present invention, as well as providing a complementary angled edge 20 on the base portion 10 opposite such corner location 15 of the present invention, improved stacking of weatherstrips 1 is shown as in FIG. 3.

Specifically, it will be appreciated that in contrast to the stacking and packaging of prior art weatherstrips that results in disorganization and pressing of the strip portions by base portions of adjacent weatherstrips, the invention as shown in FIG. 2 when stacked as shown in FIG. 3 avoids such interference between strip portions 5 and base portions 10 of adjacent weatherstrips 1. In some embodiments a first weatherstrip 1 may be stacked on a second weatherstrip 1 having an identical structure, wherein a strip portion 5 of the second weatherstrip 1 is free to angle outward with substantially no contact with a base portion 10 of the first weatherstrip 1. In other embodiments a first weatherstrip 1 may be stacked on a second weatherstrip 1 having an identical structure, wherein a strip portion 5 of the second weatherstrip 1 is free to angle outward without contacting a base portion 10 of the first weatherstrip 1. As a result, the present invention avoids undesirable shifting, potential damage and packaging and transport problems presented by stacking and packaging of prior art weatherstrips for garage doors.

In the preceding specification, various embodiments have been described with reference to the accompanying drawings. It will, however, be evident that various modifications and changes may be made thereto, and additional embodiments may be implemented, without departing from the broader scope of the exemplary embodiments as set forth in the claims that follow. The specification and drawings are accordingly to be regarded in an illustrative rather than restrictive sense.

What is claimed is:

1. A garage door weatherstrip comprising:

a rigid base portion including top, bottom, first side, and second side outermost surfaces of the garage door weatherstrip of a first rigid material;

a flexible strip portion of a second flexible material adhered to a vertex of a corner of the base portion and extending outwardly from the vertex of the corner, wherein said corner is located where the top and first side outermost surfaces meet; and a slanted face opposite said corner of the base portion to which the flexible strip portion is adhered, wherein the slanted face slants in the same direction as the flexible strip portion and the first side outermost surface joins the slanted face to said corner, and wherein, in a resting position, the flexible strip portion slants away from the vertex to a furthest distal edge of the flexible strip portion and the flexible strip portion makes obtuse angles relative to both the top outermost and the first side outermost surfaces of the base portion.

2. The weatherstrip of claim 1 wherein the flexible strip portion is tapered as progressively thinner from the corner of the base portion to the furthest distal edge of the strip portion.

3. The weatherstrip of claim 1 wherein the flexible strip portion is an extrudate and extrusion bonded to the corner of the base portion.

4. The weatherstrip of claim 2 wherein the base portion is cellular polyvinyl chloride and the strip portion is non-cellular material.

5. The weatherstrip of claim 4 wherein the flexible strip portion is an extrudate and extrusion bonded to the corner of the base portion.

6. The weatherstrip of claim 1 wherein the base portion is cellular polyvinyl chloride and the strip portion is non-cellular material.

7. The weatherstrip of claim 6 wherein the flexible strip portion is an extrudate and extrusion bonded to the corner of the base portion.

8. A weatherstrip being a first garage door weatherstrip comprising a rigid base portion including top, bottom, first side, and second side outermost surfaces of a first rigid material and a flexible strip portion of a second flexible material adhered to a vertex of a corner of the base portion and extending outwardly and slanted from the vertex of the corner to a furthest distal edge of the strip portion such that the strip portion makes obtuse angles with both the top and first side outermost surfaces when the strip portion is in a resting position, wherein the first side outermost surface connects the corner to a face slanted in the same direction as the flexible strip portion, and wherein said first weatherstrip is stacked on a second garage door weatherstrip having an identical structure, and wherein a flexible strip portion of the second weatherstrip is free to slant outward without contacting a base portion of the first weatherstrip.

9. The weatherstrip of claim 8 wherein the flexible strip portion of the first weatherstrip is tapered as progressively thinner from the corner of the base portion to the outermost furthest distal edge of the strip portion.

10. The weatherstrip of claim 9 wherein the base portion of the first weatherstrip is cellular polyvinyl chloride and the strip portion of the first weatherstrip is non-cellular material.

11. The weatherstrip of claim 10 wherein the flexible strip portion of the first weatherstrip is an extrudate and extrusion bonded to the corner of the base portion of the first weatherstrip.

12. A weatherstrip being a first garage door weatherstrip comprising a rigid base portion including top, bottom, first side, and second side outermost surfaces of the weatherstrip of a first rigid material and a flexible strip portion of a second flexible material adhered to a vertex of a corner of the base portion and extending outwardly and diagonally from the vertex of the corner when the flexible strip portion is in a resting position, wherein said first weatherstrip is stacked on a second garage door weatherstrip having an identical structure, and wherein a flexible strip portion of the second weatherstrip slants outward in a resting position from the vertex of the corner of the base portion of the second weatherstrip to a furthest distal edge of the strip portion of the second weatherstrip such that the second weatherstrip's strip portion makes obtuse angles with both the top and first side outermost surfaces of the second weatherstrip's base portion and with substantially no contact with a base portion of the first weatherstrip by extending beneath slanted edge of the first weatherstrip that has a face slanted in the same direction as the flexible strip portion of the second weatherstrip and wherein the slanted edge of the first weatherstrip is joined to said corner of the first weatherstrip by the first side outermost surface of the first weatherstrip.

13. The weatherstrip of claim 12 wherein the flexible strip portion of the first weatherstrip is tapered as progressively thinner from the corner of the base portion to the furthest distal edge.

14. The weatherstrip of claim 13 wherein the base portion of the first weatherstrip is cellular polyvinyl chloride and the flexible strip portion of the first weatherstrip is non-cellular material.

15. The weatherstrip of claim 14 wherein the flexible strip portion of the first weatherstrip is an extrudate and extrusion bonded to the corner of the base portion of the first weatherstrip.

16. The weatherstrip of claim 12 wherein the base portion of the first weatherstrip is cellular polyvinyl chloride and the flexible strip portion of the first weatherstrip is non-cellular material.

17. The weatherstrip of claim 16 wherein the flexible strip portion of the first weatherstrip is an extrudate and extrusion bonded to the corner of the base portion of the first weatherstrip.

18. The weatherstrip of claim 12 wherein the flexible strip portion of the first weatherstrip is an extrudate and extrusion bonded to the corner of the base portion of the first weatherstrip.

* * * * *